US005617661A

United States Patent [19]

Mason

[11] Patent Number: 5,617,661

[45] Date of Patent: Apr. 8, 1997

[54] FLEXIBLE SIGN BOARD FOR BLADE SIGNS

[75] Inventor: Joseph Mason, Huntington, N.Y.

[73] Assignee: NDR Corporation, Melville, N.Y.

[21] Appl. No.: 528,023

[22] Filed: Sep. 14, 1995

[51] Int. Cl.[6] ..... G09F 3/18

[52] U.S. Cl. ..... 40/642.01; 40/606; 248/900; 403/106; 403/109

[58] Field of Search ..... 40/606, 642, 649, 40/765; 248/295.11, 297.31, 580, 610, 900; 403/104, 106, 109, 377

[56] References Cited

U.S. PATENT DOCUMENTS

| | | | |
|---|---|---|---|
| 547,342 | 10/1895 | Foster | 248/610 X |
| 1,857,423 | 5/1932 | Zadek | 40/606 |
| 1,866,723 | 7/1932 | Powers | 40/606 X |
| 2,787,433 | 4/1957 | Slavsky et al. | 40/642 X |
| 4,033,536 | 7/1977 | Hillstrom . | |
| 4,593,879 | 6/1986 | Seeley et al. . | |
| 4,737,048 | 4/1988 | Herrstrom . | |
| 4,776,116 | 10/1988 | Shuman | 40/642 |
| 4,798,014 | 1/1989 | Stoerzinger et al. | 40/124.1 |
| 4,805,331 | 2/1989 | Boggess et al. | 40/651 |
| 4,909,464 | 3/1990 | Levine et al. | 40/642 X |
| 4,951,407 | 8/1990 | Werner . | |
| 5,233,773 | 8/1993 | Reynolds | 40/642 |
| 5,277,146 | 1/1994 | Hughes, Jr. . | |

*Primary Examiner*—Brian K. Green
*Attorney, Agent, or Firm*—Collard & Roe, P.C.

[57] ABSTRACT

A flexible sign board for blade signs is provided. The sign board has a frame with a mounting bracket that is connected to a resilient support. The resilient support is a plurality of springs connected to a shelf or the wall bracket according to the desired application. The springs support and maintain the sign frame perpendicular to the wall or shelf it the sign is attached to and thereby provides a "swing away" effect of the sign when bumped into or pushed out of the consumers way. The flexible sign frame and mounting thereof will not obstruct the consumer aisle, and thereby enables the increased visibility of the displayed items from a further distance. The Flexible sign board system provides the ability to adapt the sign board to an infinite variety of varying shelf depths without using or taking away valuable retail shelf space.

9 Claims, 4 Drawing Sheets

FLEXIBLE SIGN BOARD FOR BLADE SIGNS

BACKGROUND OF THE INVENTION

1. Field of the Invention

The invention relates display signs. More particularly, it relates to an apparatus for mounting display signs perpendicular to the shelves or wall to attract customers to the retail merchandise.

When shoppers move down an aisle, a display sign that is perpendicularly disposed from the display shelves is used to enable the shopper to more readily locate the material they need. These signs can be positioned at eye level extending out from the shelving or the wall. In order to prevent the display signs from becoming obtrusive, they are provided with a flexible material, such as springs, to allow the shoppers to push the sign out of the way with their carts. With the sign pushed out of the way, the aisle is opened and becomes more navigable for the shoppers.

2. The Prior Art

The patent to Boggess et al. U.S. Pat. No. 4,805,331 discloses an apparatus comprising a frame that is pivotally mounted into a hinged bracket assembly which is rigidly secured to a shelf tag molding. The frame holds promotional material on either side of its surfaces. The hinge includes a biasing spring to allow the sign to move back and forth.

The patent to Stoerzinger et al. U.S. Pat. No. 4,798,014 discloses a point of purchase display sign. This display sign consists of a single folded piece of two dimensional, rigid material.

The patent to Seely et al,, U.S. Pat. No. 4,593,879 U.S. Pat. No. 4,737,048 to Herrstrom, and U.S. Pat. No. 4,033,536 to Hillstrom all disclose a signs using coiled springs for warning people on the road.

The patent to Huges, U.S. Pat. No. 5,277,146, discloses a laterally supported flexible sign for use along roads. The elastomeric braces supporting the sign allows the sign to be deflected when hit by a passing object.

The patent to Werner, U.S. Pat. No. 4,951,407 discloses a yieldable sign stand that includes a mechanism that permits pivoting of the sign when subject to wind loads and further includes a mechanism may be for applying a restoring force to restore the sign to its normal vertical position upon removal of the wind load.

SUMMARY OF THE INVENTION

A flexible sign board for blade signs having resilient support means for supporting the sign in a perpendicular orientation with respect to the wall or shelf to which it is mounted. Mounting brackets are provided along the frame of the sign and are slidably adjustable within the frame to provide vertical adjustment. The mounting brackets have support pins for matingly receiving one end of support springs. The other end of the springs are matingly engaged by support pins on the shelf mounting bracket or the wall mounting brackets. The shelf mounting bracket further includes a vertical adjustment system. The wall mounting brackets can be vertically adjusted along the wall for variable placement. The support springs enable the sign to "swing away" when bumped into and thereby does not obstruct the passage of consumers.

An adjustable wall bracket enables the adjustment of the length of the bracket according to the desired application. A non-adjustable wall bracket is provided for specific size applications. Thus, the flexible sign board system according to the invention has the ability to adapt to an infinite variety of varying shelf depths, without using or taking valuable shelf space from the retail display.

In another embodiment of the invention, the resilient support means, or the springs, are replaced by a rigid support means. The rigid support means is more economical than the spring supports, however the "swing away" feature is compromised. In all embodiments of the invention, the flexible sign board with mounting brackets is slightly laterally flexible with respect to the shelf or wall to which is attached.

Therefore, an object of the invention is to provide an apparatus for placing advertising messages/signs in a store aisle, perpendicular to the shelving, to attract customers as they come down the aisle.

It is another object of the invention to provide a display sign that is adjustable in three dimensions to accommodate various spacing between shelves.

It is yet another object of the invention to provide a display sign that uses springs to support the sign and further enable a swing away safety feature for preventing the sign from obstructing the shopper.

It is a further object of the invention to provide a display sign that operates reliably and efficiently.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
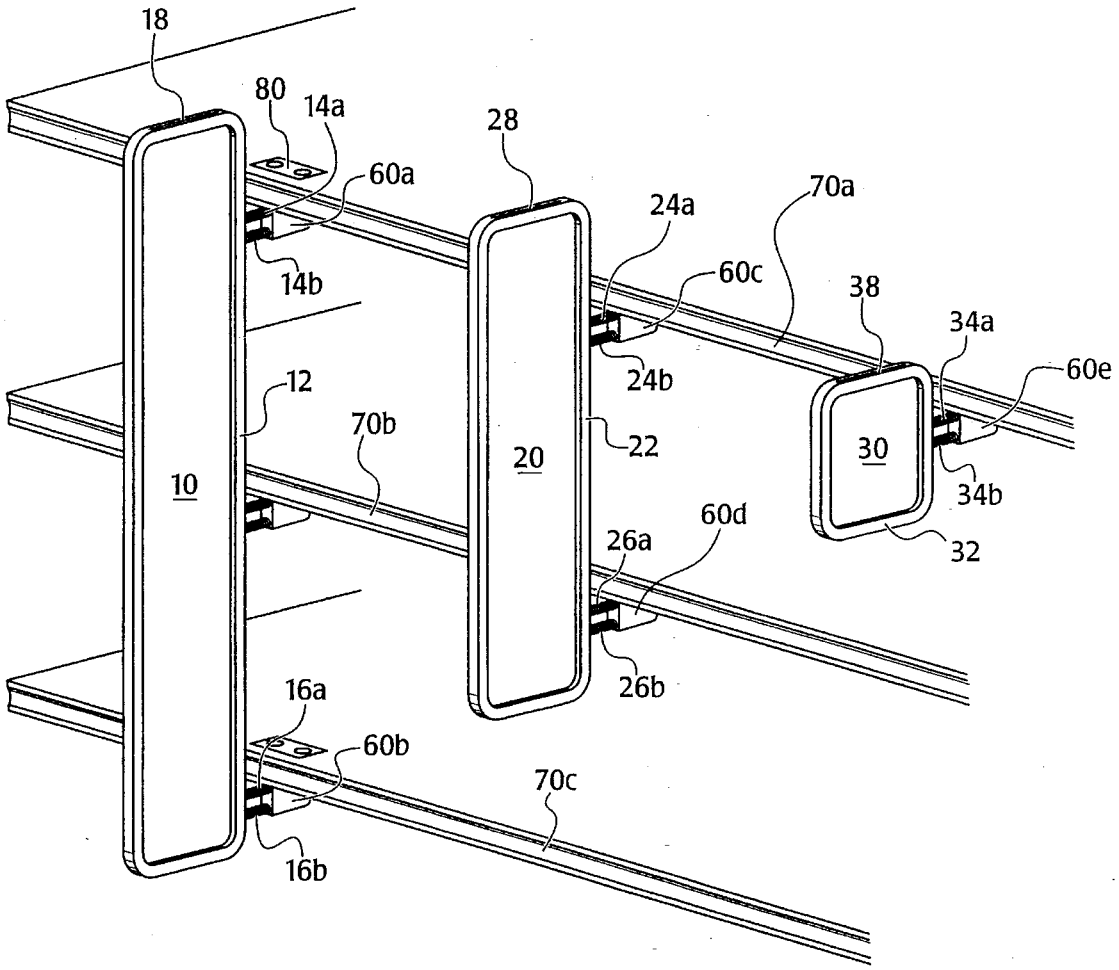
FIG. 1 is a perspective view of three different blade sign frames according to the invention.

FIG. 1 shows three signs 10, 20 and 30, each having a sign frame 12, 22, and 32, respectively. The sign frames 12, 22, and 32 have a sign receiving slot 18, 28, and 38, respectively, for receiving a display sign into signs 10, 20, and 30, respectively.

Display sign 10 is secured to shelf 70*a* and 70*c* with shelf mounting brackets 60*a* and 60*b*, respectively. Mounting bracket 60*a* is coupled to frame 12 via springs 14*a* and 14*b*, and mounting bracket 60*b* is coupled to frame 12 via springs 16*a* and 16*b*. springs 14*a*, 14*b*, 16*a*, and 16*b* retain and support sign 10 in a substantially perpendicular position with respect to shelves 70*a*–70*c*, in addition to providing sign 10 with the ability to "swing away" from its perpendicular position when bumped into or pushed such that said sign is not an obstruction in the aisle.

Sign 20 is supported on shelves 70*a* and 70*b* via shelf mounting brackets 60*c* and 60*d*, respectively. Sign 30 is smaller than signs 10 and 20, and as such, only one mounting bracket 60*e* is needed. Mounting bracket 60*e* has two springs 34*a* and 34*b* for supporting sign 30 and enabling the resilient swinging of said sign with respect to shelf 70*a*. In all embodiments, the springs 14*a*, 14*b*, 16*a*, 16*b*, 24*a*, 24*b*, 26*a*, 26*b*, 34*a* and 34*b* support the respective sign and maintain said signs in the desired perpendicular position with respect to shelves 70*a*–70*c*.

Figure 2:
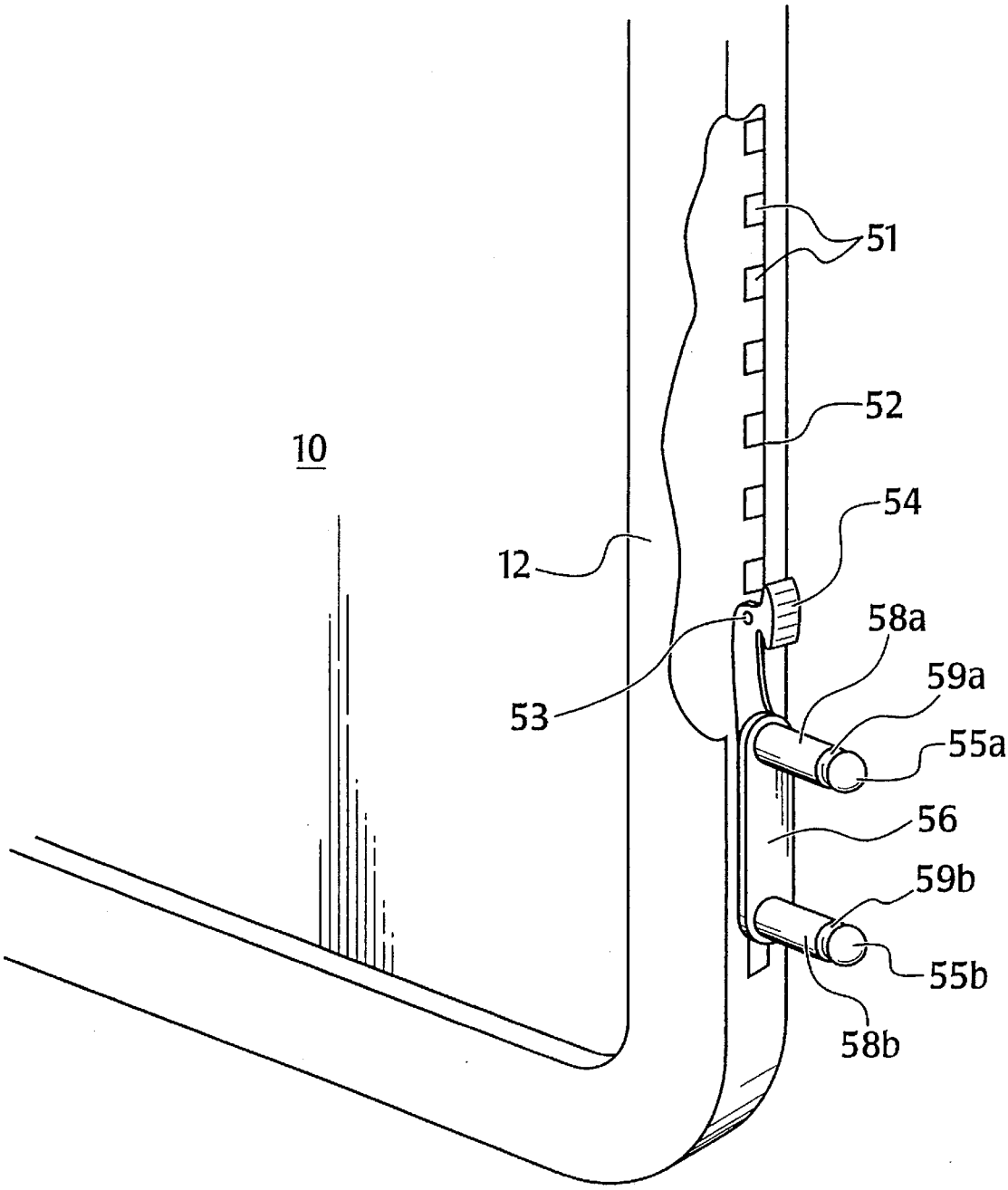
FIG. 2 is a schematic view, partially broken away, of the slidable mounting pins of the blade sign frame according to the invention.
Figure 3:
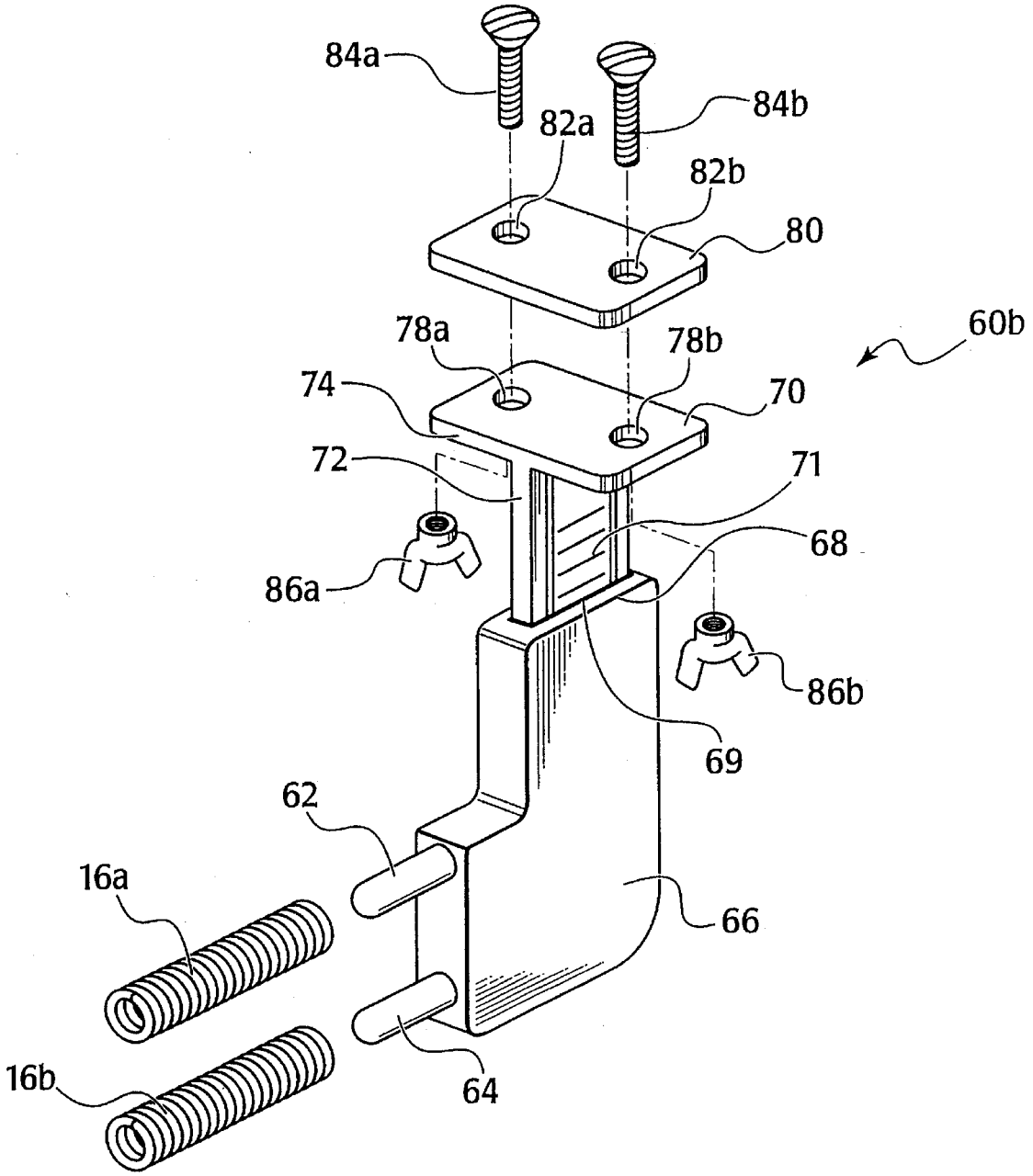
FIG. 3 is an exploded perspective view of the shelf mount bracket according to the invention.

Referring to FIGS. 2 and 3, the frame 12 is provided with a mounting bracket 56 for receiving and securing frame 12 to the springs. Mounting bracket 56 is slidably disposed within a slot 52 within frame 12 and is secured into a desired position by button 54. Slot 52 is longitudinally disposed within frame 12. Button 54 has a notch 53 on each side thereof which engages a plurality of ratchet slots 51. Upon depression of button 54, notch 53 is released from a secure position between the ratchet slots 51, and mounting bracket 56 can then be slid within slot 52. Once bracket 56 is in the desired position, button 54 is released and notch 53 will be engaged between ratchet slots 51 to secure said bracket in place. The releasable ratchet mechanism of slots 51 and notch 53 can be modified or changed with any other suitable known means of releasable adjustment devices. This adjustment can be made before or after the sign has been attached to the respective springs.

Mounting bracket 56 has two securing pins 58*a* and 58*b* which extend outward from said bracket to receiving the respective springs. Each of securing pins 58*a* and 58*b* have a spherical head portion 55*a* and 55*b*, and a circumferential notch 59*a* and 59*b*, respectively.

FIG. 3 shows an exploded view of shelf mounting bracket 60*b* according to the invention. Bracket 60*b* has an L-shaped body 66 having pins 62 and 64 extending therefrom to receive springs 16*a* and 16*b*. Springs 16*a* and 16*b* are secured onto pins 62 and 64, respectively, at one end, and secured onto securing pins 58*a* and 58*b* at the other end. Springs 16*a* and 16*b* have an inner circumference slightly smaller than the circumference of pins 62 and 64 such that said springs can frictionally engage said pins without sliding off. The spherical shape ends 59*a* and 59*b* of pins 58*a* and 59*b*, respectively, help to enable the swinging motion of the display sign when attached to the springs. The spherical ends 59*a* and 59*b* can move more freely within the confines of the spring without affecting the attachment of springs 16*a* and 16*b* to mounting bracket 60*b* and sign frame 12.

At the upper portion 68 of shelf mounting bracket 60*b*, a T-shaped mount 70 is disposed for attachment to a shelf. The vertical portion 72 of mount 70 is disposed within slot 69 in the body 66 of bracket 60*b*. The horizontal portion 74 of mount 70 rests against the underside of the shelf and has two holes 78*a* and 78*b* for receiving screws 84*a* and 84*b*, respectively. A mounting plate 80 is to be disposed on the top side of the shelf such that holes 82*a* and 82*b* are aligned with holes 78*a* and 78*b*, respectively. Screws 84*a* and 84*b* pass through holes 82*a* and 82*b* in mounting plate 80, through the shelf and into holes 78*a* and 78*b*, respectively. Screws 84*a* and 84*b* are secured in place by wing nuts 86*a* and 86*b*, respectively. The lateral adjustability of shelf mounting bracket 60*b* is determined by its placement on the shelf.

Holes 78*a* and 78*b* in mount 70 and holes 82*a* and 82*b* in mounting plate 80 are to be aligned with the pre-existing holes in the shelf. Thus, no drilling of new holes in the shelf should be required. However, should the user desire to place the sign at an area on the shelf without holes, new holes can be made according to the size of screws 84*a* and 84*b*.

The vertical portion 72 of mount 70 can include ridges 71 for selectively adjusting the height of mount 70 with respect to body 66. Ridges 71 are engaged within body 66 and further enable the adjustment of the sign position once the shelf mounting bracket is secured to the shelf.

Figure 4:
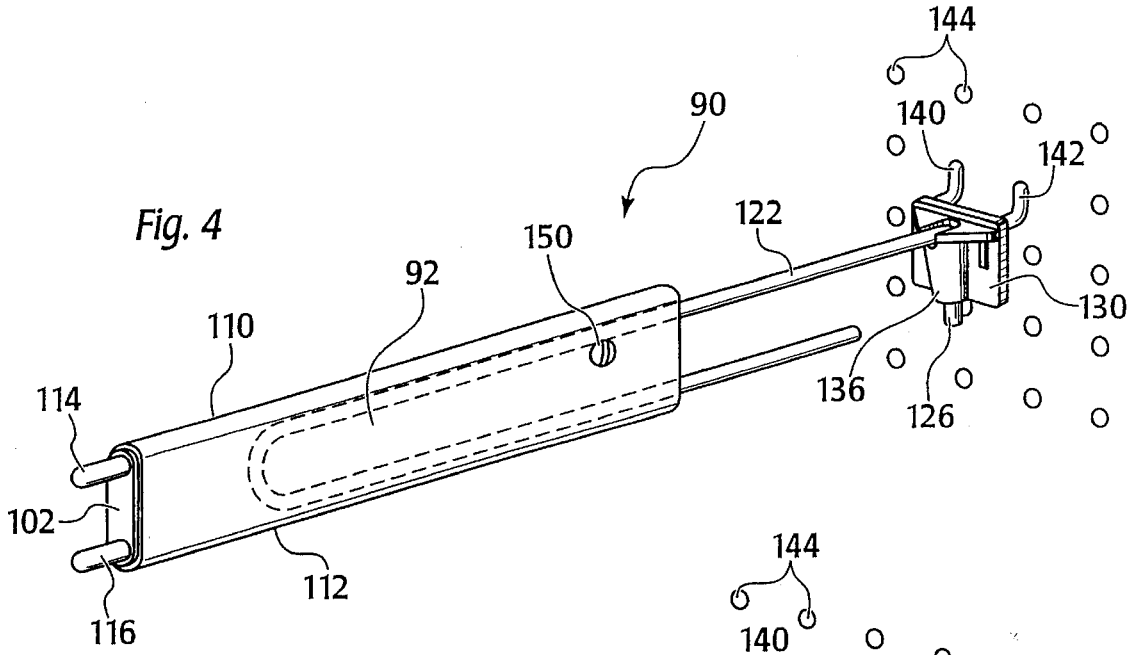
FIG. 4 is an adjustable wall mount bracket according to the invention.

FIG. 4 shows an embodiment of an adjustable wall mount bracket 90 according to the invention. Wall mount bracket 90 has a flat wall bracket 130 which has two pegs 140 and 142 for securing bracket 90 to a peg board wall 144. Flat wall bracket 130 further has a receptacle 136 for receiving the support arm 122 of bracket 90.

Adjustable wall mount bracket 90 has a U-shaped primary support rod 122 having an L-shaped portion 126 at the end of one of the legs thereof that engages and secures rod 122 to flat wall bracket 130 via receptacle 136. An extension member 92 encloses the U-shaped end of primary support rod 122, and has a substantially oval cross-section shown at the outer end 102. Extension member 92 has a rounded top 110 and rounded bottom 112 and includes two pins 114 and 116 each for attaching to one end of a spring for supporting a display sign. Pins 114 and 116 have a circumference slightly larger that the inner circumference of the springs such that said springs frictionally engage said pins. Extension member 92 includes an adjustment screw 150 that releasably secures extension member 92 to primary support rod 122 such that the distance between outer end 102 and wall 144 can be adjusted according the desired application.

Figure 5:
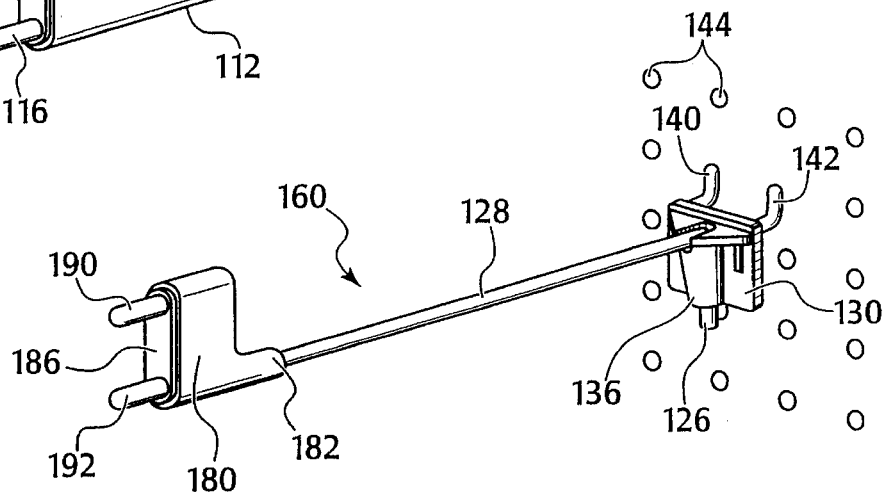
FIG. 5 is a non-adjustable wall mount bracket for known depth applications according to the invention.

FIG. 5 shows a non-adjustable wall mount bracket 160 according to the invention. Bracket 160 is mounted to a peg board wall 144 in the same configuration as adjustable wall mount bracket 90. Bracket 160 includes primary support rod 128, but does not have an extension member or means for changing its length. At the end of support rod 128 is a connector 180 coupled to said support rod through end 182. Connector 180 has two pins 190 and 192 for receiving springs to couple bracket 160 to a display sign. Pins 190 and 192 have a circumference slightly larger that the inner circumference of the springs such that said springs frictionally engage said pins.

Figure 6:
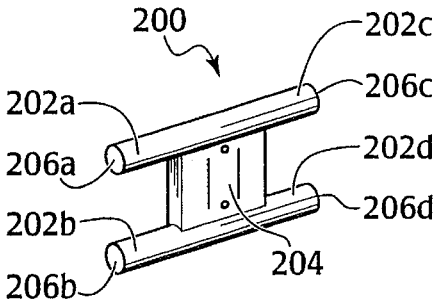
FIG. 6 is an embodiment of an adaptor pin according to the invention.

FIG. 6 shows an H-shaped coupler 200 according to the invention. Coupler 200 has four receiving ends 206*a*–206*d* connected by a center portion 204. Coupler 200 provides an alternative method of securing display signs 10, 20, and 30 to the shelf mounting bracket 60 or wall mount brackets 90 and 160. Coupler 200 eliminates the springs from the prior embodiments and provides a rigid frictional connection between the wall and shelf mount and the sign. Although this is more economical than the spring embodiments, coupler 200 eliminates the "swing away" feature provided by the spring construction.

While several embodiments of the present invention have been shown and described, it is to be understood that many changes and modifications may be made thereunto without departing from the spirit and scope of the invention as defined in the appended claims.

I claim:

1. A flexible sign board for blade signs comprising:

a sign frame having a top, a bottom, and two opposite sides, said top having a slot for receiving a blade sign;

at least one attachment means disposed within one of said opposite sides of said frame and having at least one support pin extending outward from said side, said at least one attachment means comprising:

a slot formed in one of said opposite sides of said sign frame, said slot having an inner cavity;

a plurality of notches longitudinally disposed within said inner cavity of said slot;

a mounting bracket slidably disposed within said slot, said at least one support pin having a circumference and being integrally formed with said mounting bracket; and locking means coupled to said mounting bracket for engaging said plurality of notches and locking said mounting bracket in a desired position;

support means having a first end coupled to said at least one support pin and an opposite second end; and mounting means coupled to said second end of said support means for securing said support means and thereby the sign frame to a stationary object.

2. The flexible sign board according to claim 1, wherein said at least one support means comprises at least one spring having an inner circumference slightly smaller than said circumference of said at least one support pin such that said spring can be releasably and securely fastened to said support pin.

3. The flexible sign board according to claim 2, wherein said mounting means comprises:

an L-shaped shelf bracket having a lower end and an upper end, said upper end having a mount slot disposed therein;

at least one support pin extending from said lower end and being frictionally coupled with said at least one spring;

a mount having a vertical portion slidably disposed within said slot in said upper end of said bracket and a horizontal portion integrally formed with said vertical portion, said horizontal portion having at least two securing holes disposed therein;

a mounting plate having at least two holes corresponding to said at least two holes in said horizontal portion of said mount, said horizontal portion being disposed on the underside of a shelf having holes disposed therein and said mounting plate being disposed in the top side of the shelf such that said holes in each the horizontal portion, the mount and shelf are axially aligned with each other; and securing screws for matingly engaging said holes in the mounting plate, the shelf and the mount and securing said shelf bracket to the shelf.

4. The flexible sign board according to claim 2, wherein said mounting means comprises:

a flat wall mount bracket having at least two pegs for securing said bracket to a peg board wall and a support receptacle;

a U-shaped support rod having a first leg and a second leg, said first leg being longer than said second leg and having an L-shaped end for insertion into said support receptacle; and an extension member having an open end, an opposite closed end, at least one support pin extending from said closed end, and a securing mechanism for securing said extension member at a predetermined location along said support rod, said extension member being slidably disposed around said U-shaped support rod.

5. The flexible sign board according to claim 2, wherein said mounting means comprises:

a flat wall mount bracket having at least two pegs for securing said bracket to a peg board wall and a support receptacle;

a support rod having a first L-shaped end for insertion into said support receptacle and a second L-shaped end oppositely directed than said first L-shaped end; and a connector coupled to said second L-shaped end of said support rod, said connector having at least one support pin frictionally engaging said spring.

6. The flexible sign board according to claim 2, wherein said at least one support means comprises a rigid connector having two opposite sides and at least one support pin receiving hole in each of said sides.

7. The flexible sign board according to claim 6, wherein said mounting means comprises:

an L-shaped shelf bracket having a lower end and an upper end, said upper end having a mount slot disposed therein;

at least one support pin extending from said lower end and having a circumference, said at least one support pin frictionally engaging said at least one support pin receiving hole in said rigid connector;

a mount having a vertical portion slidably disposed within said slot in said upper end of said bracket and a horizontal portion integrally formed with said vertical portion, said horizontal portion having at least two securing holes disposed therein;

a mounting plate having at least two holes corresponding to said at least two holes in said horizontal portion of said mount, said horizontal portion being disposed on the underside of a shelf having holes disposed therein and said mounting plate being disposed in the top side of the shelf such that said holes in each the horizontal portion, the mount and shelf are axially aligned with each other; and securing screws for matingly engaging said holes in the mounting plate, the shelf and the mount and securing said shelf bracket to the shelf.

8. The flexible sign board according to claim 6, wherein said mounting means comprises:

a flat wall mount bracket having at least two pegs for securing said bracket to a peg board wall and a support receptacle;

a U-shaped support rod having a first leg and a second leg, said first leg being longer than said second leg and having an L-shaped end for insertion into said support receptacle; and an extension member having an open end, an opposite closed end, at least one support pin extending from said closed end, and a securing mechanism for securing said extension member at a predetermined location along said support rod, said extension member being slidably disposed around said U-shaped support rod.

9. The flexible sign board according to claim 6, wherein said mounting means comprises:

a flat wall mount bracket having at least two pegs for securing said bracket to a peg board wall and a support receptacle;

a support rod having a first L-shaped end for insertion into said support receptacle and a second L-shaped end oppositely directed than said first L-shaped end; and a connector coupled to said second L-shaped end of said support rod, said connector having at least one support pin frictionally engaging said at least one support pin receiving hole in said rigid connector.

* * * * *